US009666959B2

(12) United States Patent
Yamamoto

(10) Patent No.: US 9,666,959 B2
(45) Date of Patent: May 30, 2017

(54) WIRE HARNESS

(71) Applicant: SUMITOMO WIRING SYSTEMS, LTD., Mie (JP)

(72) Inventor: Morichika Yamamoto, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 15/296,355

(22) Filed: Oct. 18, 2016

(65) Prior Publication Data

US 2017/0125926 A1 May 4, 2017

(30) Foreign Application Priority Data

Oct. 29, 2015 (JP) ..... 2015-212658

(51) Int. Cl.

| | |
|---|---|
| ***H01R 11/00*** | (2006.01) |
| ***H01R 9/24*** | (2006.01) |
| ***H01R 4/72*** | (2006.01) |
| ***H01B 7/00*** | (2006.01) |
| ***H01R 4/18*** | (2006.01) |

(52) U.S. Cl.

CPC ..... *H01R 9/2416* (2013.01); *H01B 7/0045* (2013.01); *H01R 4/185* (2013.01); *H01R 4/72* (2013.01)

(58) Field of Classification Search

CPC ..... H01R 9/2416; H01R 4/72; H01R 4/185; H01B 7/0045

USPC ..... 439/502–506, 709, 722, 932

See application file for complete search history.

(56) References Cited

U.S. PATENT DOCUMENTS

| | | | | |
|---|---|---|---|---|
| 7,374,445 | B2 * | 5/2008 | Gouzien | H01R 13/565 439/320 |
| 7,530,821 | B2 * | 5/2009 | Miyake | G09F 3/10 29/873 |
| 7,530,847 | B2 * | 5/2009 | Siems | H01R 13/58 439/607.41 |
| 2013/0240265 | A1 | 9/2013 | Itou et al. | |

FOREIGN PATENT DOCUMENTS

| | | |
|---|---|---|
| JP | 2012-074176 | 4/2012 |
| JP | 2014-073637 | 4/2014 |

* cited by examiner

*Primary Examiner* — Khiem Nguyen
(74) *Attorney, Agent, or Firm* — Greenblum & Bernstein, P.L.C.

(57) ABSTRACT

A wire harness includes a plurality of covered electrical wires where an insulation sheath is peeled off of each covered electrical wire to expose a lead wire end portion, a connection terminal fixed to an end portion of the covered electrical wire, a heat-shrinkable tube having a hot-melt adhesive laminated to an inner surface thereof covering a predetermined area in a heat-shrunk state, and a connector that irremovably houses the connection terminal in each terminal insertion hole. A connection-side end surface of the connector that is on a side where the connection terminal is connected is positioned so as to conform to an end of the heat shrunk heat-shrinkable tube near a first barrel portion. The connector has a holding tube portion extending integrally from the connection-side end surface and that covers the heat shrunk heat-shrinkable tube, the holding tube portion having a tubular hole that holds the heat-shrinkable tube.

1 Claim, 7 Drawing Sheets

Prior Art

Prior Art

Prior Art

WIRE HARNESS

CROSS-REFERENCE TO RELATED APPLICATIONS

The present application claims priority under 35 U.S.C. §119 of Japanese Application No. 2015-212658, filed on Oct. 29, 2015, the disclosure of which is expressly incorporated by reference herein in its entirety.

BACKGROUND OF THE INVENTION

1. Field of the Invention

The present invention relates to a wire harness having an electrical wire that has a connector provided to an end portion thereof.

2. Description of Related Art

Traditionally, in a wire harness having an electrical wire that has a connector provided to an end portion thereof, a structure is often employed where a connection terminal crimped to the end portion of the electrical wire is inserted and locked in a terminal insertion hole of the connector (see FIGS. 6A and 6B). In this structure, different types of metal may be used in a lead wire constituting the electrical wire, and the connection terminal. Contact potential difference occurs in an area where dissimilar metals are in contact with each other, and when moisture acting as an electrolyte aqueous solution adheres to the contact area, corrosion may occur on the metal having a lower standard electrode potential.

For example, in a case where a copper connection terminal is crimped to an aluminum electrical wire, when moisture adheres to a contact area thereof, corrosion tends to occur on the aluminum electrical wire which has a lower standard electrode potential.

For this reason, in a case where dissimilar metals are connected to each other, such as in a case where a copper terminal is crimped to an aluminum electrical wire for example, various types of a waterproofing shield are applied to the connection area thereof in order to prevent galvanic corrosion of the connection area (see, for example, Japanese Patent Laid-Open Publication No. 2012-074176, FIG. 3, Paragraph [0016] and Japanese Patent Laid-Open Publication No. 2014-073637, FIGS. 1 and 3).

In Japanese Patent Laid-Open Publication No. 2012-074176, a technology is disclosed in which a corrosion-proofing member 140 is used to prevent electrolytic corrosion of a portion of a terminal-provided electrical wire 120 where metals of a terminal 130 and the electrical wire 120 are in contact with each other (see FIG. 7). The corrosion-proofing member 140 is a long tubular member configured by an adhering portion 142 and a corrosion-proof covered portion 144. The corrosion-proofing member 140 covers a core wire crimped portion 134 of the terminal 130 and a core wire exposed portion 122 of the electrical wire 120 to which the core wire crimped portion 134 is crimped, thereby preventing corrosion of the portion where metals of the terminal 130 and the electrical wire 120 are in contact with each other.

In Japanese Patent Laid-Open Publication No. 2014-073637, a heat-shrinkable tube is disclosed which includes a heat-shrinkable resin tube and an adhesive layer provided to an inner surface thereof, where the adhesive layer is provided to only a middle portion in a lengthwise direction of the resin tube. After a joint portion of an insulation-covered electrical wire is inserted into the heat-shrinkable tube, the heat-shrinkable tube is heated and caused to shrink in a radial direction. The heat causes the adhesive layer to flow and cover the joint portion, and the joint portion is further covered by the shrunk heat-shrinkable tube, thereby waterproofing and corrosion-proofing the joint portion.

However, in a case where the heat-shrinkable tube provided with adhesive (as disclosed in Japanese Patent Laid-Open Publication No. 2014-073637) is used to apply the waterproofing shield to the crimped area of the electrical wire and the connection terminal (as disclosed in Japanese Patent Laid-Open Publication No. 2012-074176), first, the connection terminal crimped to the end portion of the electrical wire is inserted into the heat-shrinkable tube, then, after the heat-shrinkable tube is positioned and fixated so as to adequately cover the crimped area, the heat-shrinkable tube is heated and heat shrunk (see FIGS. 5A-5C). This results in an increase in working man-hours as well as low precision with respect to positioning of the waterproofing shield.

SUMMARY OF THE INVENTION

The present invention is conceived to solve the above-noted issues. The present invention improves waterproofing performance by precisely covering a heat-shrinkable tube over a predetermined area of a connection terminal-provided electrical wire requiring a waterproofing shield, thereby enabling prevention of galvanic corrosion, and provides a wire harness having a favorable assembly workability.

In order to achieve the above-noted objective, a wire harness according to the present invention is configured to have a plurality of covered electrical wires where an insulation sheath is peeled off of each covered electrical wire to expose a lead wire end portion; a connection terminal having a connection portion, a first barrel portion, and a second barrel portion, the connection terminal fixating at the first barrel portion the lead wire end portion and fixating at the second barrel portion the end portion where the insulation sheath has been peeled off; a plurality of heat-shrinkable tubes, the heat-shrinkable tube having an inner surface that is laminated with an hot-melt adhesive and that covers, in a heat-shrunk state, an area including an area from the lead wire end portion to a fixating portion of the connection terminal that fixates the insulation sheath; and a connector that irremovably houses in each terminal insertion hole thereof only the connection portion of the connection terminal. The adhesive melts when the heat-shrinkable tube is heat shrunk and occupies and solidifies in an interior space of the insulation sheath, thereby blocking water, and a connection-side end surface of the connector on a side where the connection terminal is connected is positioned so as to conform to an end of the heat shrunk heat-shrinkable tube near the first barrel portion. The connector has a holding tube portion extending integrally from the connection-side end surface and that covers the heat shrunk heat-shrinkable tube, the holding tube portion having a tubular hole that holds the heat-shrinkable tube having a length identical to that of the heat-shrinkable tube prior to heat shrinkage.

In this configuration, in the wire harness according to the present invention, in a state where the heat-shrinkable tube prior to heat shrinkage is held in the tubular hole of the holding tube portion on the connector side, the connection terminal fixed to the end portion of the covered electrical wire is passed through the heat-shrinkable tube and the connection portion of the connection terminal can be irremovably inserted in the terminal insertion hole of the connector. Thereafter, by applying heat from outside the holding tube portion, the heat-shrinkable tube can be caused to heat shrink and cover the area including the area from the lead wire end portion to the fixating portion of the connection terminal fixating the insulation sheath. In other words, when an operation of inserting the connection portion of the connection terminal into the terminal insertion hole is performed, a conventional operation of passing the covered electrical wire through the heat-shrinkable tube is performed simultaneously therewith. As a result, there is no need to separately perform the conventional operation of passing the covered electrical wire through the heat-shrinkable tube, thus enhancing assembly workability.

In addition, since the holding tube portion has a length identical to that of the heat-shrinkable tube prior to heat shrinkage and extends integrally from the connection-side end surface of the connector, when the connection portion of the connection terminal is housed in the terminal insertion hole of the connector, the heat-shrinkable tube is at all times accurately positioned at a same position with respect to the covered electrical wire provided with the connection terminal. In this state, by applying heat from outside the holding tube portion and causing the heat-shrinkable tube to heat shrink, the heat-shrinkable tube can be made to accurately cover the area of the covered electrical wire that requires the waterproofing shield, thus enhancing waterproofing performance. As a result, galvanic corrosion can be effectively prevented even when the lead wire of the covered electrical wire and the connection terminal are made of dissimilar metals.

The present invention improves waterproofing performance by precisely covering the heat-shrinkable tube over the predetermined area of the connection terminal-provided electrical wire requiring the waterproofing shield, thereby enabling prevention of galvanic corrosion, and provides the wire harness having a favorable assembly workability.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1A:
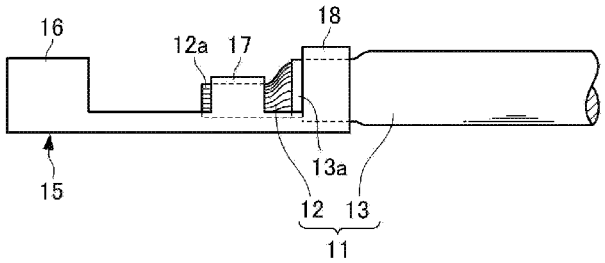
FIG. 1A is a lateral view of a covered electrical wire having a connection terminal attached thereto according to a first embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the forms of the present invention may be embodied in practice.

In the following, an embodiment of a wire harness according to the present invention is described with reference to the drawings.

First Embodiment

First, a first embodiment of the present invention is described with reference to FIGS. 1A and 1B through FIGS. 3A and 3B.

A wire harness 1 according to the first embodiment of the present invention includes a plurality of covered electrical wires 11 where an insulation sheath 13 is peeled off of each covered electrical wire 11 to expose a lead wire end portion 12*a*, a connection terminal 15 fixed to an end portion of each covered electrical wire 11, a heat-shrinkable tube 30 in a heat-shrunk state covering a predetermined area of the end portion of each covered electrical wire 11 that requires a waterproofing shield, and a connector 19.

Figure 1B:
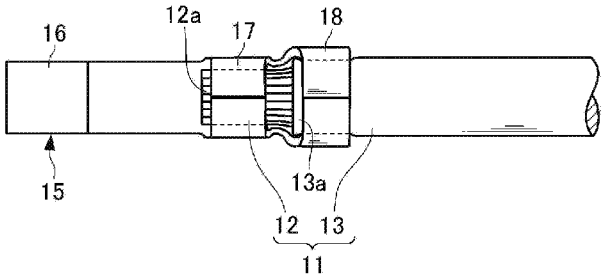
FIG. 1B is a plan view thereof.

As illustrated in FIGS. 1A and 1B, each covered electrical wire 11 includes a lead wire 12 having a bundle of aluminum wires having a small diameter and the insulation sheath 13 made of a PVC (polyvinyl chloride) material and the like that covers the lead wire 12, and has a configuration in which the end portion (a length of 10-15 mm, for example) of the insulation sheath 13 is peeled off to expose the lead wire 12. It is noted that the lead wire 12 can also be one aluminum wire or the like having a large diameter. Further, the lead wire 12 can be a copper wire.

As illustrated in FIGS. 1A and 1B, the connection terminal 15 has a connection portion 16, a first barrel portion 17, and a second barrel portion 18, the connection terminal 15 fixating at the first barrel portion 17 the lead wire end portion 12*a* and fixating at the second barrel portion 18 an end portion 13*a* where the insulation sheath 13 has been peeled off.

In this example, the connection portion 16 has a rectangular tubular shape; that is, it is formed into a female shape; however, the connection portion 16 may have a male shape. The first barrel portion 17 and the second barrel portion 18 prior to assembly are each a flat plate piece portion having a pair of flat plates opened on left and right sides thereof, which flat plates are crimped into a hugging position by a crimping tool. The connection terminal 15 fixates the lead wire 12 by crimping the first barrel portion 17 so as to hug the lead wire 12, and fixates the end portion 13*a* with the insulation sheath 13 peeled off by crimping the second barrel portion 18 so as to hug the end portion 13*a*. As described above, the connection terminal 15 is provided to the end portion of each covered electrical wire 11. The connection terminal 15 can be a molded body made by sheet metal processing a conductive metal plate such as copper, oxygen-free copper (electroplating tin), brass, or aluminum alloy, for example.

A hot-melt adhesive 32 is laminated to an inner surface of the heat-shrinkable tube 30. In addition, the heat-shrinkable tube 30 in the heat-shrunk state covers an area including an area from the lead wire end portion 12*a* to a fixating portion of the connection terminal 15 fixating the insulation sheath 13.

The heat-shrinkable tube 30 can be a tubular member made of, for example, synthetic resin such as polyolefin resin, nylon resin, silicon resin, fluorine resin, or polyester elastomer resin. The heat-shrinkable tube 30 can be manufactured, for example, by forming a very thin tubular resin member using a melting extruder or the like, then crosslinking the resin by irradiation of ionizing radiation or the like, then increasing a diameter of the resin member by feeding compressed air into an interior of the tube, and then fixating the tube by cooling. The heat-shrinkable tube 30 formed in this way has a shape memory characteristic such that when heated, the heat-shrinkable tube 30 shrinks in a radial direction into the thin tubular shape prior to increasing the diameter thereof.

When the heat-shrinkable tube 30 heat shrinks, the adhesive 32 laminated to the inner surface of the heat-shrinkable tube 30 melts. The melted adhesive 32 occupies and solidifies in an interior space of the insulation sheath 13, thereby blocking water.

The adhesive 32 can be, for example, a hot-melt adhesive such as a heat-melting (thermoplastic) polyester resin, polyamide resin, or polyolefin resin.

The connector 19 has a configuration in which only the connection portion 16 of the connection terminal 15 is irremovably housed in each terminal insertion hole 20.

Specifically, as illustrated in FIGS. 2A and 2B and FIGS. 3A and 3B, the connector 19 includes a plurality of terminal insertion holes 20 and a lock piece 22 protruding from a side of a hole wall inside each terminal insertion hole 20. The connector 19 houses the connection portion 16 of the connection terminal 15 in each terminal insertion hole 20. The lock piece 22 is pressed back by the connection portion 16 when the connection portion 16 passes the lock piece 22 upon insertion but returns to a protruding state thereafter. Thus, the lock piece 22 abuts against a rear end of the connection portion 16 in an inserting direction, thereby irremovably housing the connection portion 16 in the connector 19. A counterpart terminal receiving hole 26 is formed on a front end portion of the connector 19 to receive a counterpart connection terminal.

The connector 19 can be, for example, an injection-molded body made of an LCP (liquid crystal polymer) resin in which anisotropy has been relaxed by combining fillers such as glass fibers (GF) and inorganic fillers and the like therewith and which thus has excellent precision moldability and heat-resistance, or made of polyester resin, polyamide resin, polypropylene resin, polyethylene resin, or the like. Further, the connector 19 can be an injection-molded body made of a reinforced polyethylene terephthalate resin combined with GF and inorganic fillers.

In addition, in the connector 19, a connection-side end surface 29 on a side where the connection terminal 15 is connected is positioned so as to conform to an end of the heat shrunk heat-shrinkable tube 30 near the first barrel portion 17. Further, the connector 19 has a holding tube portion 24 extending integrally from the connection-side end surface 29 and that covers the heat shrunk heat-shrinkable tube 30, the holding tube portion 24 having a tubular hole 25 that holds the heat-shrinkable tube 30 having a length identical to that of the heat-shrinkable tube 30 prior to heat shrinkage.

Figure 2A:
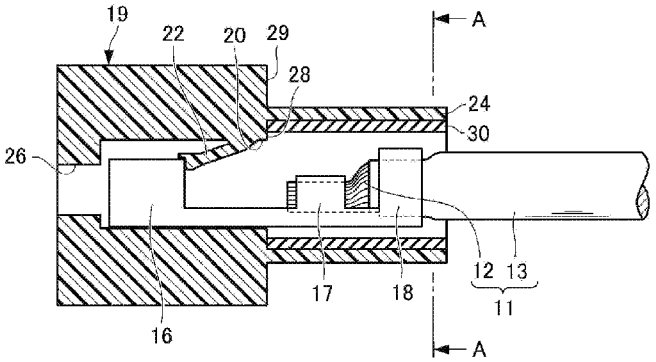
FIG. 2A is a cross-sectional view of the connection terminal of the covered electrical wire of FIGS. 1A and 1B being fitted to a connector in a state where a heat-shrinkable tube prior to heat shrinkage is inserted in the connector according to the first embodiment of the present invention.
Figure 2B:
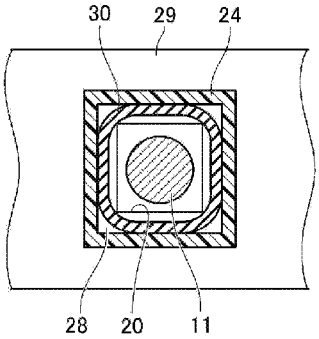
FIG. 2B is a cross-sectional view taken along line A-A of FIG. 2A.
Figure 3A:
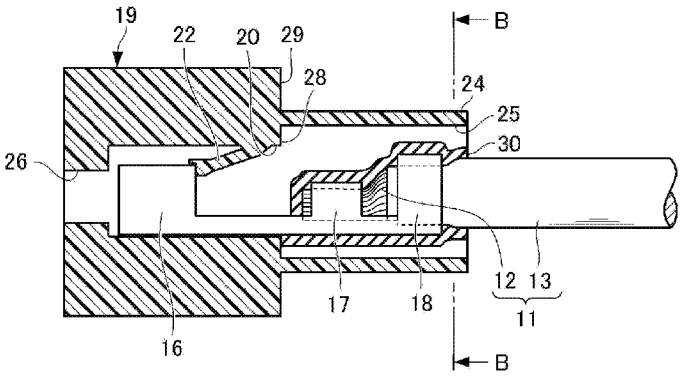
FIG. 3A is a cross-sectional view of a state in which the heat-shrinkable tube has been heat shrunk from the state illustrated in FIGS. 2A and 2B according to the first embodiment of the present invention.
Figure 3B:
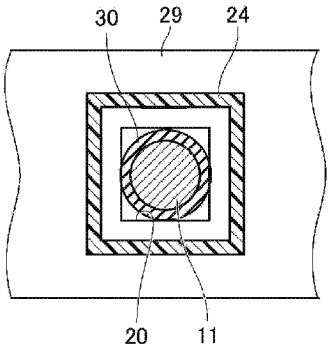
FIG. 3B is a cross-sectional view taken along line B-B of FIG. 3A.

As illustrated in FIG. 2B, the holding tube portion 24 has a rectangular cross-section and the tubular hole 25 of the holding tube portion 24 is larger than the terminal insertion hole 20 illustrated in FIG. 2B in a plane view. Thus, as illustrated in FIG. 2A, a front end portion in a longitudinal direction of the tubular hole 25 and a rear end portion in the longitudinal direction of the terminal insertion hole 20 are connected in a step shape. An abutting surface portion 28 extending vertically in the longitudinal direction is formed on the step shape portion. Thus, in a case where the heat-shrinkable tube 30 is housed in the tubular hole 25, by inserting a front end portion in the longitudinal direction of the heat-shrinkable tube 30 until the front end portion abuts against the abutting surface portion 28, the heat-shrinkable tube 30 can at all times be accurately positioned at a predetermined position in the longitudinal direction inside the tubular hole 25.

In addition, as illustrated in FIG. 2A, since the holding tube portion 24 has a longitudinal length identical to that of the heat-shrinkable tube 30, in a case where the heat-shrinkable tube 30 is housed in the tubular hole 25, by inserting the rear end portion of the heat-shrinkable tube 30 until the rear end portion is flush with an end surface of the holding tube portion 24, the heat-shrinkable tube 30 can at all times be accurately positioned at the predetermined position in the longitudinal direction inside the tubular hole 25.

Further, in a state where the heat-shrinkable tube 30 prior to heat shrinkage is housed in the tubular hole 25, the covered electrical wire 11 provided with the connection terminal 15 can be passed through the tubular hole 25 so as to house the connection portion 16 in the terminal insertion hole 20.

In addition, a wall portion constituting the holding tube portion 24 has a thinness such that, in a state where the heat-shrinkable tube 30 is housed therein, the heat-shrinkable tube 30 can be efficiently heat shrunk when heated from outside the holding tube portion 24 by a dryer and the like. The connection-side end surface 29 is formed on a base portion of the holding tube portion 24 for this reason. However, the holding tube portion 24 has a strength enough to hold the heat-shrinkable tube 30 prior to heat shrinkage.

In addition to holding the heat-shrinkable tube 30 prior to heat shrinkage, the holding tube portion 24 also protects the end portion of the covered electrical wire 11 to which the connection terminal 15 is attached.

The holding tube portion 24 is configured such that the tubular hole 25 thereof has an inner peripheral length that is longer than an outer peripheral length of the heat-shrinkable tube 30 prior to heat shrinkage. In this configuration, it is possible to house the heat-shrinkable tube 30 inside the tubular hole 25 without causing the heat-shrinkable tube 30 to distort more than necessary.

In addition, it is preferable for a length of a short side of a rectangular cross-section of the tubular hole 25 of the holding tube portion 24 to be slightly shorter than a diameter of an outer shape of the heat-shrinkable tube 30 prior to heat shrinkage. As a result, when the heat-shrinkable tube 30 is inserted in the tubular hole 25, a wall portion of the heat-shrinkable tube 30 is elastically deformed and a pair of mutually opposing wall portions corresponding to the short side of the rectangular cross-section of the tubular hole 25 are pressed by the wall portion of the heat-shrinkable tube 30, thereby ensuring that the heat-shrinkable tube 30 is held by the holding tube portion 24. Further to this state, a pair of mutually opposing wall portions corresponding to a long side of the rectangular cross-section of the tubular hole 25 can be made to be pressed by the wall portion of the elastically deformed heat-shrinkable tube 30. This increases the holding strength of the holding tube portion 24.

Next, an assembly method of the present invention is described.

First, the heat-shrinkable tube 30 is inserted into the tubular hole 25 of the holding tube portion 24 of the connector 19. Next, the covered electrical wire 11 having the connection terminal 15 provided to the end portion thereof is inserted into the holding tube portion 24 of the connector 19, and the connection portion 16 is pressed into the terminal insertion hole 20 until the connection portion 16 is locked by the lock piece 22. Thereafter, heat is applied from outside the holding tube portion 24 by a dryer or the like, thereby causing the heat-shrinkable tube 30 to heat shrink in the radial direction and cover the predetermined waterproofing shield area of the end portion of the covered electrical wire 11. When the heat-shrinkable tube 30 is heat shrunk, the hot-melt adhesive 32 laminated to the inner surface of the heat-shrinkable tube 30 melts. The melted hot-melt adhesive 32 occupies and solidifies in the interior space of the insulation sheath 13, thereby blocking water. This completes assembly of the present invention.

Next, the operation and effects of the present invention are described.

In the wire harness 1 according to the first embodiment of the present invention, in a state where the heat-shrinkable tube 30 prior to heat shrinkage is held in the tubular hole 25 of the holding tube portion 24 on the connector side, the connection terminal 15 provided to the end portion of the covered electrical wire 11 is passed through the heat-shrinkable tube 30 and the connection portion 16 of the connection terminal 15 can be irremovably inserted in the terminal insertion hole 20 of the connector 19. Thereafter, by applying heat from outside the holding tube portion 24, the heat-shrinkable tube 30 can be caused to heat shrink and cover the area including the area from the lead wire end portion 12*a* to the fixating portion of the connection terminal 15 fixating the insulation sheath 13. Therefore, when an operation of inserting the connection portion 16 of the connection terminal 15 into the terminal insertion hole 20 is performed, a conventional operation of passing the covered electrical wire 11 through the heat-shrinkable tube 30 is performed simultaneously therewith. As a result, there is no need to separately perform the conventional operation of passing the covered electrical wire 11 through the heat-shrinkable tube 30, thus enhancing assembly workability.

In addition, since the holding tube portion 24 has the longitudinal length identical to that of the heat-shrinkable tube 30 prior to heat shrinkage and extends integrally from the connection-side end surface 29 of the connector 19, when the connection portion 16 of the connection terminal 15 is housed in the terminal insertion hole 20 of the connector 19, the heat-shrinkable tube 30 is at all times accurately positioned at a same position with respect to the covered electrical wire 11 provided with the connection terminal 15. In this state, by applying heat from outside the holding tube portion 24 and causing the heat-shrinkable tube 30 to heat shrink, the heat-shrinkable tube 30 can be made to accurately cover the area of the covered electrical wire 11 that requires the waterproofing shield, thus enhancing waterproofing performance. As a result, galvanic corrosion can be effectively prevented even when the lead wire 12 of the covered electrical wire 11 and the connection terminal 15 are made of dissimilar metals.

Second Embodiment

Figure 4A:
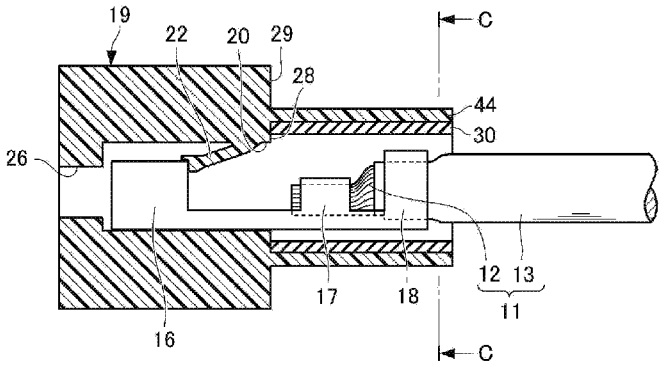
FIG. 4A is a cross-sectional view of the connection terminal of the covered electrical wire of FIGS. 1A and 1B being fitted to the connector in a state where the heat-shrinkable tube prior to heat shrinkage is inserted in the connector according to a second embodiment of the present invention.
Figure 4B:
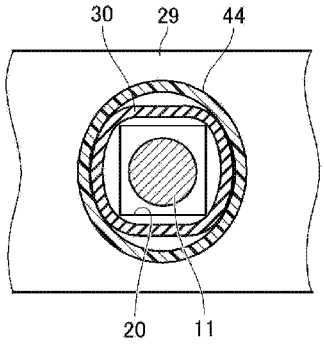
FIG. 4B is a cross-sectional view taken along line C-C of FIG. 4A.
Figure 5A:
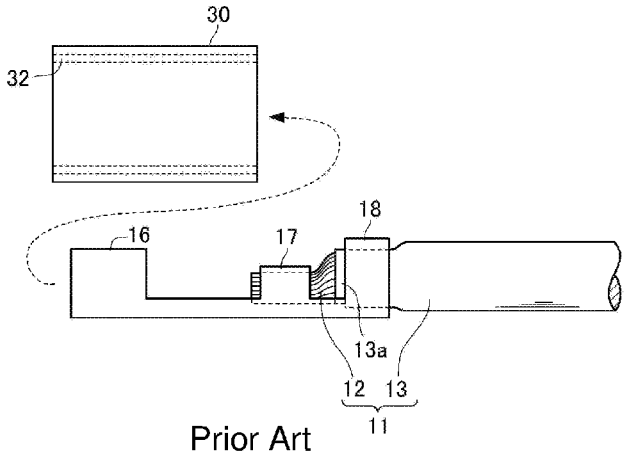
FIGS. 5A-5C are explanatory diagrams illustrating a state in which the heat-shrinkable tube is fitted on the covered electrical wire having the connection terminal attached thereto according to conventional technology.
Figure 5B:
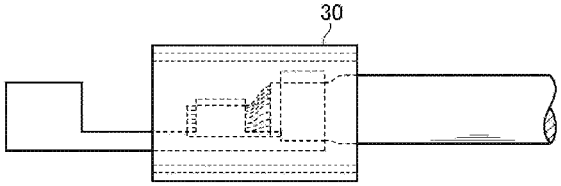
Prior Art Fig. 5B
Figure 5C:
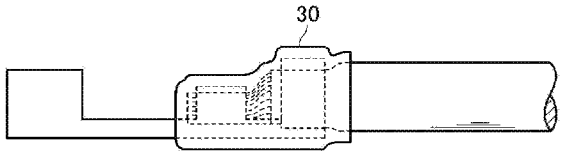
Prior Art Fig. 5C
Figure 6A:
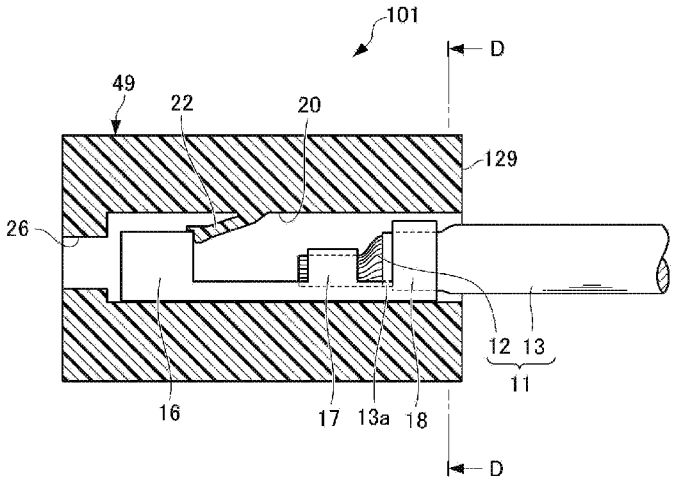
FIG. 6A is a cross-sectional view of a state in which the connection terminal-provided covered electrical wire is fitted to the connector according to conventional technology.
Figure 6B:
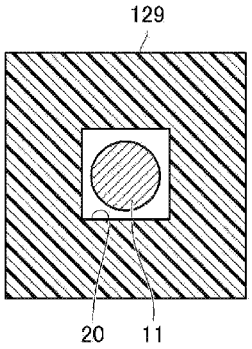
Prior Art Fig. 6B
FIG. 6B is a cross-sectional view taken along line D-D of FIG. 6A.
Figure 7:
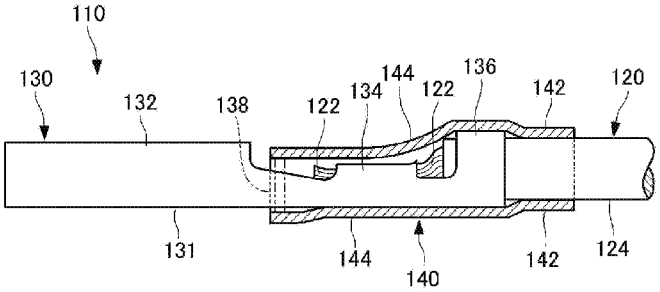
FIG. 7 illustrates a terminal-provided electrical wire as disclosed in Japanese Patent Laid-Open Publication No. 2012-074176 according to conventional technology.

Next, a second embodiment of the present invention is described. FIGS. 4A and 4B illustrate a state in which the heat-shrinkable tube 30 prior to heat shrinkage is held in a holding tube portion 44 according to the second embodiment of the present invention. The second embodiment of the present invention differs from the first embodiment only in the cross-sectional shape of the holding tube portion 44. Therefore, other components are assigned reference numerals identical to those of the first embodiment and descriptions of the configuration, operation, and effects thereof are omitted.

As illustrated in FIG. 4B, the holding tube portion 44 has an elliptical cross-section. A tubular hole 45 of the holding tube portion 44 is larger than the terminal insertion hole 20 illustrated in FIG. 4B in a plan view. Thus, similar to the first embodiment of the present invention, the abutting surface portion 28 is formed in the step shape on a seam of the tubular hole 45 and the terminal insertion hole 20. Thus, in a case where the heat-shrinkable tube 30 is housed in the tubular hole 45, by inserting the front end portion in the longitudinal direction of the heat-shrinkable tube 30 until the front end portion abuts against the abutting surface portion 28, the heat-shrinkable tube 30 can at all times be accurately positioned at a predetermined position in the longitudinal direction inside the tubular hole 45.

The holding tube portion 44 is configured such that the tubular hole 45 thereof has an inner peripheral length that is longer than the outer peripheral length of the heat-shrinkable tube 30 prior to heat shrinkage. According to this configuration, it is possible to house the heat-shrinkable tube 30 inside the tubular hole 45 without causing the heat-shrinkable tube 30 to distort more than necessary.

In addition, it is preferable for a short diameter of the elliptical cross-section of the tubular hole 45 of the holding tube portion 44 to be smaller than the diameter of the outer shape of the heat-shrinkable tube 30 prior to heat shrinkage. As a result, when the heat-shrinkable tube 30 is inserted in the tubular hole 45, the wall portion of the heat-shrinkable tube 30 is elastically deformed and a pair of mutually opposing wall portions corresponding to the short diameter of the elliptical cross-section of the tubular hole 45 are pressed by the wall portion of the heat-shrinkable tube 30, thereby ensuring that the heat-shrinkable tube 30 is held by the holding tube portion 44.

In addition, the elliptical cross-section of the tubular hole 45 of the holding tube portion 44 allows for a relatively wide area of an outer peripheral surface of the heat-shrinkable tube 30 to be in contact with an inner peripheral surface of the tubular hole 45, in a state where the heat-shrinkable tube 30 prior to heat shrinkage is housed therein. Accordingly, in a case where heat is applied from outside the holding tube portion 44, the heat-shrinkable tube 30 can be heated efficiently.

Although the description of each of the above-noted embodiments focused primarily on a single terminal insertion hole 20 in the connector 19 and the holding tube portions 24 and 44 corresponding thereto, it goes without saying that a plurality of terminal insertion holes and a plurality of holding tube portions can be provided to the connector 19. Further, the cross-section of each of the holding tube portions 24 and 44 can have an arbitrary shape such as a circular shape, an oblong rectangular shape or a polygonal shape, in addition to a rectangular shape and an elliptical shape.

The wire harness according to the present invention improves waterproofing performance by precisely covering the heat-shrinkable tube over the predetermined area of the connection terminal-provided electrical wire requiring the waterproofing shield, thereby enabling prevention of galvanic corrosion, and also has a favorable assembly workability. The wire harness according to the present invention is generally useful for wire harnesses that include an electrical wire having a connector provided to an end portion thereof.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A wire harness, comprising:

a plurality of covered electrical wires having an insulation sheath peeled off of each covered electrical wire to expose a lead wire end portion;

a connection terminal having a connection portion, a first barrel portion, and a second barrel portion, the connection terminal fixating at the first barrel portion the lead wire end portion and fixating at the second barrel portion the end portion where the insulation sheath has been peeled off;

a plurality of heat-shrinkable tubes, each heat-shrinkable tube having an inner surface that is laminated with a hot-melt adhesive and that covers, in a heat-shrunk condition, an area including an area from the lead wire end portion to a fixating portion of the connection terminal that fixates the insulation sheath; and a connector having a plurality of terminal insertion holes, each of which irremovably houses only the connection portion of the connection terminal, wherein, the adhesive melts when the heat-shrinkable tube is heat shrunk and occupies and solidifies in an interior space of the insulation sheath, thereby blocking water, a connection-side end surface of the connector on a side where the connection terminal is connected is positioned so as to conform to an end of the heat shrunk heat-shrinkable tube near the first barrel portion, and the connector comprises:

a holding tube portion extending integrally from the connection-side end surface and that covers the heat shrunk heat-shrinkable tube, the holding tube portion having a tubular hole that holds the heat-shrinkable tube having a length corresponding to that of the heat-shrinkable tube prior to heat shrinkage.

* * * * *